US008872748B2

(12) United States Patent
Cho et al.

(10) Patent No.: US 8,872,748 B2
(45) Date of Patent: Oct. 28, 2014

(54) LIQUID CRYSTAL DISPLAY DEVICE AND DRIVING METHOD THEREOF

(75) Inventors: Soondong Cho, Gumi-si (KR); Hyuntaek Nam, Daegu (KR); Jeongho Kang, Gumi-si (KR); Jongwoo Kim, Gumi-si (KR)

(73) Assignee: LG Display Co., Ltd., Seoul (KR)

( * ) Notice: Subject to any disclaimer, the term of this patent is extended or adjusted under 35 U.S.C. 154(b) by 1138 days.

(21) Appl. No.: 12/457,942

(22) Filed: Jun. 25, 2009

(65) Prior Publication Data

US 2010/0134451 A1 Jun. 3, 2010

(30) Foreign Application Priority Data

Dec. 3, 2008 (KR) ..... 10-2008-0122149

(51) Int. Cl.
*G09G 3/36* (2006.01)

(52) U.S. Cl.
CPC ..... *G09G 3/3677* (2013.01); *G09G 3/3688* (2013.01); *G09G 2310/063* (2013.01); *G09G 2310/0218* (2013.01); *G09G 2320/0261* (2013.01); *G09G 2230/00* (2013.01)
USPC ..... 345/99; 345/98; 345/100

(58) Field of Classification Search
CPC ..... G09G 3/36; G09G 3/3685; G09G 3/3688; G09G 3/3696
USPC ..... 345/205, 94–96, 98–100, 103
See application file for complete search history.

(56) References Cited

U.S. PATENT DOCUMENTS

| | | | | |
|---|---|---|---|---|
| 2001/0003448 | A1 * | 6/2001 | Nose et al. | 345/99 |
| 2003/0227428 | A1 | 12/2003 | Nose | |
| 2006/0044301 | A1 | 3/2006 | Ha | |
| 2006/0238525 | A1 * | 10/2006 | Hong et al. | 345/204 |
| 2006/0291298 | A1 | 12/2006 | Kang et al. | |
| 2007/0040795 | A1 * | 2/2007 | Lee et al. | 345/100 |
| 2007/0242019 | A1 * | 10/2007 | Jung et al. | 345/98 |
| 2008/0238897 | A1 | 10/2008 | Kimura | |

FOREIGN PATENT DOCUMENTS

| | | |
|---|---|---|
| CN | 101276533 | 10/2008 |
| DE | 102006003406 | 1/2007 |
| JP | 11073169 | 3/1999 |
| WO | WO 2008038431 | 4/2008 |

* cited by examiner

*Primary Examiner* — Jonathan Horner
(74) *Attorney, Agent, or Firm* — McKenna Long & Aldridge LLP

(57) ABSTRACT

A liquid crystal display device and a driving method thereof capable of simplifying of a hardware construction of the liquid crystal display device driven by the impulsive driving method and minimizing capacitance of memory for storing data are provided.

8 Claims, 14 Drawing Sheets

LIQUID CRYSTAL DISPLAY DEVICE AND DRIVING METHOD THEREOF

This application claims priority under 35 U.S.C. §119(a) to Korean Patent Application No. 10-2008-122149 filed in the Republic of Korea on Dec. 3, 2008, the entire contents of which are hereby incorporated by reference for all purposed as if fully set forth herein.

BACKGROUND OF THE INVENTION

1. Field of the Invention

This document relates to an impulsive driving liquid crystal display device and a driving method thereof.

2. Discussion of the Related Art

An active matrix driving liquid crystal display device displays a moving image using thin film transistors (TFTs) as switching elements. Since the liquid crystal display device can be formed into a small size compared to a cathode ray tube (CRT), it is applied to a television set as well as a display device in a portable information device, an office machine, a computer, etc., and gradually replaces the CRT.

The liquid crystal display device has a motion blur phenomenon in which a picture of a moving image is blurred due to retention characteristics of the liquid crystal. As shown in FIG. 1, the CRT displays an image in an impulsive driving method, in which light is emitted from a fluorescent material for a very short time to display data in a cell and then light is not emitted from the cell any more. Compared to this, as shown in FIG. 2, the liquid crystal display device displays an image in a hold-type driving method, in which data is supplied to a liquid crystal cell during a scanning period and then the data charged in the liquid crystal cell is maintained for the remaining field period (or frame period).

Since the moving image displayed on the CRT is driven in the impulsive driving method, the image perceived by a viewer becomes clear as shown in FIG. 3. On the contrary, as shown in FIG. 4, in the moving image displayed on the liquid crystal display device, the image perceived by the viewer is blurred due to the retention characteristics of the liquid crystal. The difference of images perceived the CRT and the liquid crystal display device results from an integration effect of the image that continues temporarily in the viewer's eyes that follow the movement. Accordingly, even though a response speed of the liquid crystal display device is high, the viewer sees a blurred image by discordance between the movement of eyes and a static image for each frame. In order to improve the motion blur phenomenon, the impulsive driving method that drives the liquid crystal display device by inserting black data on a screen after displaying video data on the screen, i.e., a black data insertion (BDI) method is proposed. For example, as shown in FIG. 5, according to the black data insertion method, a screen is divided into three blocks, a video data voltage is sequentially charged by each line in one block A1 of the divided blocks, and a black voltage is simultaneously charged by continuous four lines in another block A2. In the this manner, the black data insertion method accomplishes an impulsive driving effect by sequentially charging video data lines one by one in the respective blocks A1 to A3 and then sequentially charging a black voltage by four lines. In order to simultaneously select the lines in which the black voltage is charged, a gate drive IC simultaneously applies gate pulses to adjacent gate lines.

However, the impulsive driving method needs many line memories because it is necessary to make a driving frequency of the liquid crystal display device high and to store a large quantity of data for many lines. Furthermore, it is necessary to make a logic circuit and a control algorithm of a timing controller complicated.

SUMMARY OF THE INVENTION

The Exemplary embodiments have been made in an effort to provide a liquid crystal display device and a driving method thereof, which can simultaneously simplify of a hardware construction of the liquid crystal display device driven by the impulsive driving method and minimize capacitance of memory for storing data.

In one aspect, a liquid crystal display comprises, a liquid crystal display panel on which a plurality of data lines and a plurality of gate lines cross each other, and having a common electrode; a timing controller for generating a gate timing control signal and a data timing signal, wherein the gate timing control signal includes a first gate start pulse, a second gate start pulse, a gate shift clock, a first gate output enable signal and a second gate output enable signal, and wherein the data timing signal includes a first source output enable signal and a second source output enable signal; a data driving circuit for supplying positive polarity/negative polarity analog video data voltages to the data lines video when the first and second source output enable signals are input thereto at a same logic level, and supplying positive polarity/negative polarity black voltages to the data lines in response to a pulse of the second source output enable signal; a first gate drive IC for shifting the first gate start pulse in accordance with the gate shift clock, and sequentially supplying first gate pulses which are synchronized with the positive polarity/negative polarity analog video data voltages to the gate lines included a first block of the liquid crystal display panel during a low logic period of the first gate output enable signal; and a second gate drive IC for shifting a first carry signal supplied from the first gate drive IC in accordance with the gate shift clock and sequentially supplying second gate pulses which are synchronized with the positive polarity/negative polarity black voltages to the gate lines included a second block of the liquid crystal display panel during a low logic period of the second gate output enable signal.

In another aspect, a method of driving a liquid crystal display device comprising a liquid crystal display panel on which a plurality of data lines and a plurality of gate lines cross each other and having a common electrode, the method comprising: generating a gate timing control signal and a data timing control signal, wherein the gate timing control signal including a first gate start pulse, a second gate start pulse, a gate shift clock, a first gate output enable signal and a second gate output enable signal, and wherein the data timing control signal including a first source output enable signal and a second source output enable signal; supplying positive polarity/negative polarity analog video data voltages to the data lines video data voltage to the data lines when the first and second source output enable signals are input at a same logic level, and supplying positive polarity/negative polarity black voltages to the data lines in response to a pulse of the second source output enable signal by using a data driving circuit; shifting the first gate start pulse in accordance with the gate shift clock and sequentially supplying first gate pulses which are synchronized with the positive polarity/negative polarity analog video data voltages to the gate lines included a first block of the liquid crystal display panel during a low logic period of the first gate output enable signal by using a first gate drive IC; and shifting a first carry signal supplied from the first gate drive IC in accordance with the gate shift clock, and sequentially supplying second gate pulses which are synchronized with the positive polarity/negative polarity black voltages to the gate lines included a second block of the liquid crystal display panel during a low logic period of the second gate output enable signal by using a second gate drive IC.

BRIEF DESCRIPTION OF THE DRAWINGS

The accompanying drawings, which are included to provide a further understanding of the invention and are incorporated in and constitute a part of this specification, illustrate exemplary embodiments of the invention and together with the description serve to explain the principles of the invention. In the drawings.

DETAILED DESCRIPTION OF THE PREFERRED EMBODIMENTS

Figure 1:
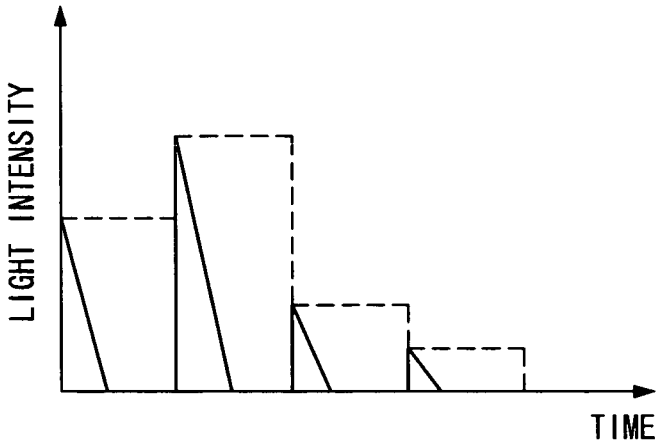
FIG. 1 RELATED ART
FIG. 1 is a characteristic diagram showing emission characteristics of a cathode ray tube.
Figure 2:
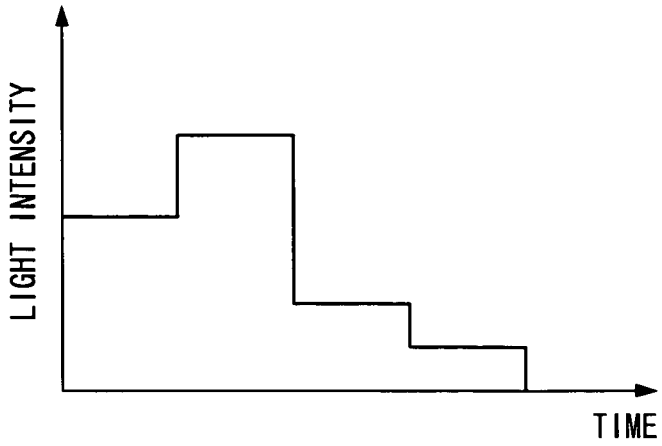
FIG. 2 RELATED ART
FIG. 2 is a characteristic diagram showing retention characteristics of a liquid crystal display device.
Figure 3:
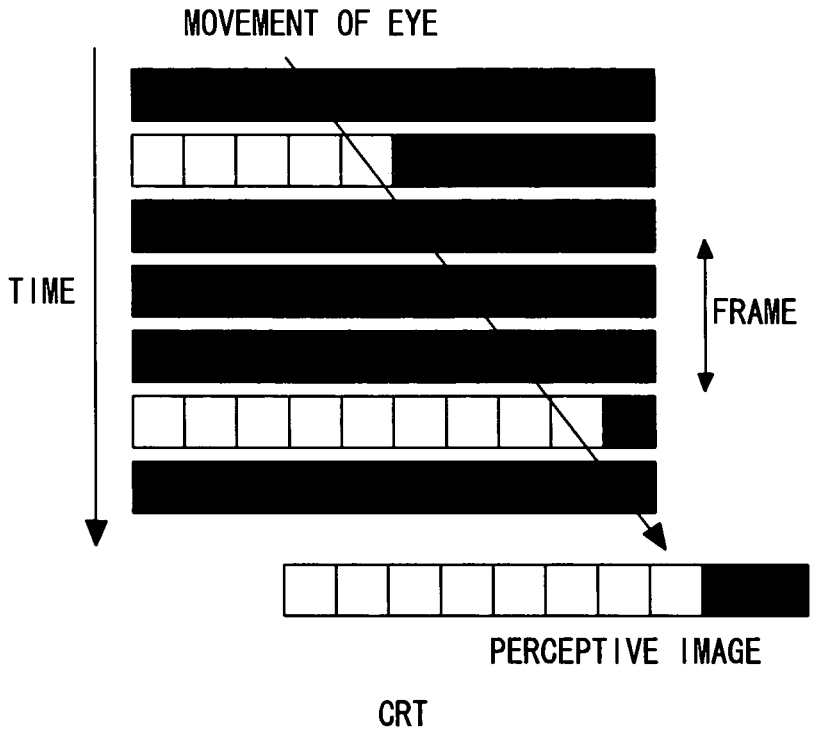
FIG. 3 RELATED ART
FIG. 3 is a diagram showing an image of a cathode ray tube perceived by a viewer.
Figure 4:
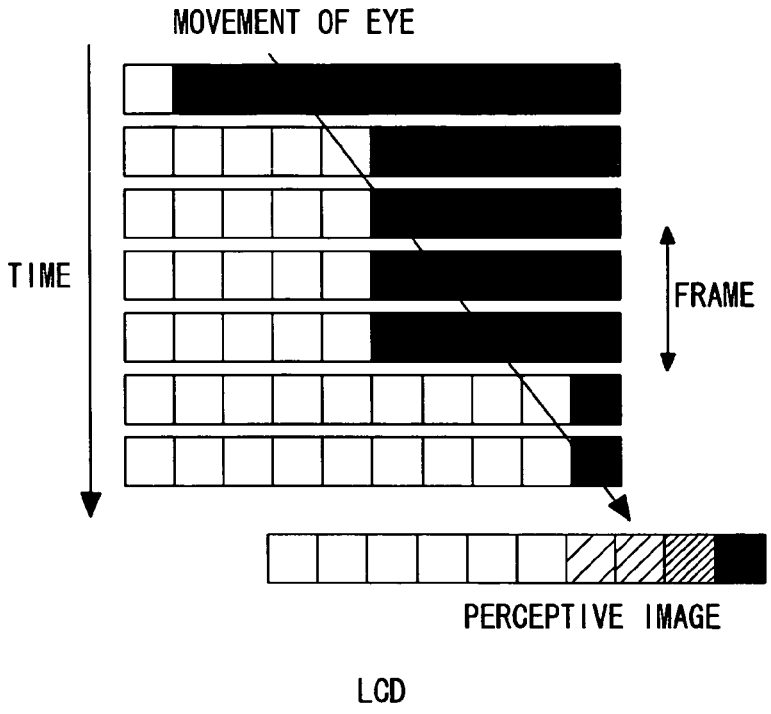
FIG. 4 RELATED ART
FIG. 4 is a diagram showing an image of a liquid crystal display device perceived by a viewer.
Figure 5:
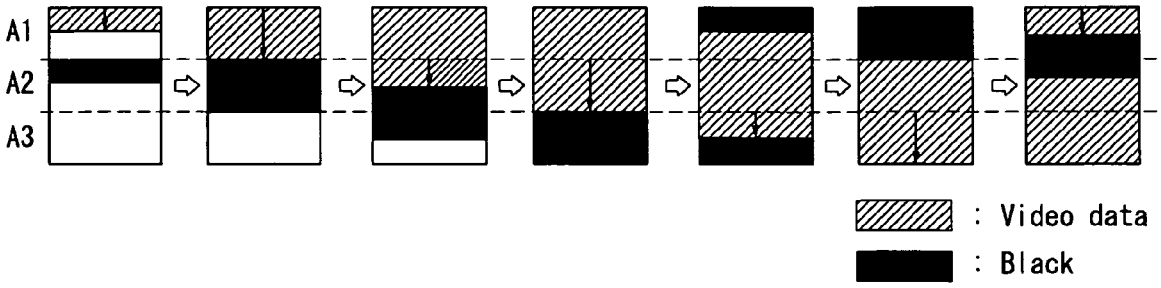
FIG. 5 RELATED ART
FIG. 5 is a diagram showing scanning operations of video data voltages and black voltages in a black data insertion method.
Figure 6:
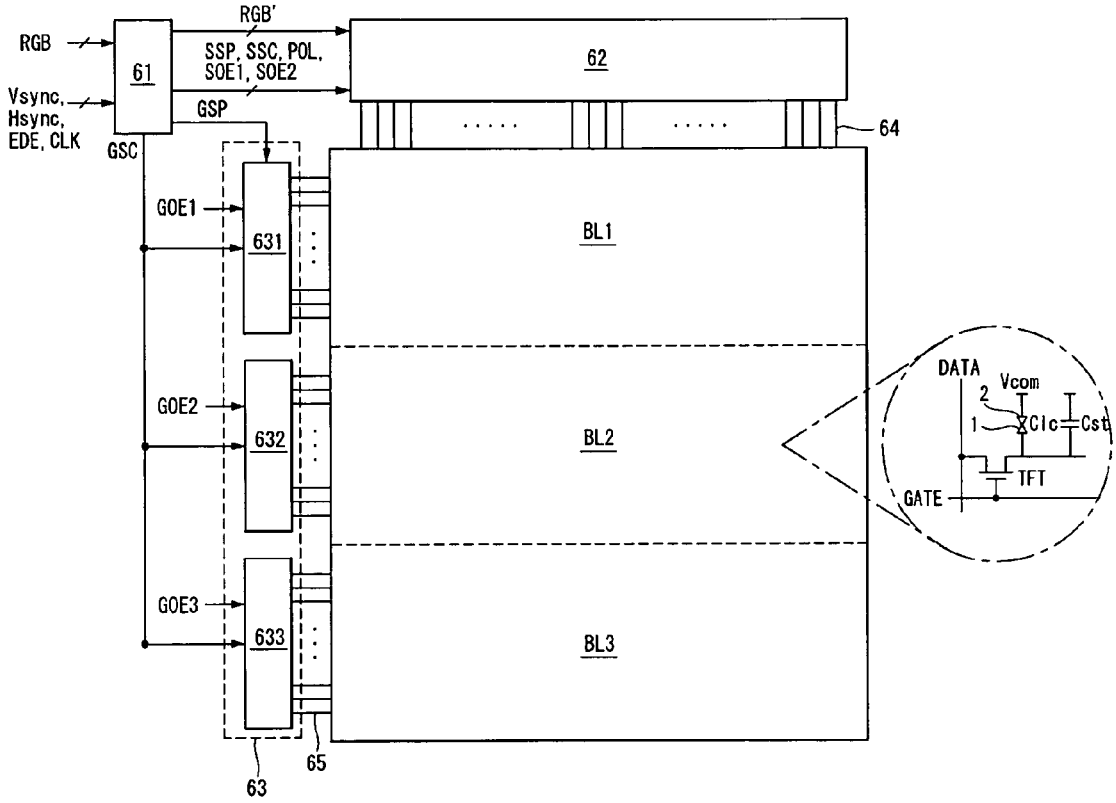
FIG. 6 is a block diagram showing a liquid crystal display device according to an exemplary embodiment of this invention.

Hereinafter, exemplary embodiments of the invention will be described in detail with reference to the accompanying drawings so that this disclosure is thorough and completely and fully conveys the concept of the invention to those skilled in the art.

Hereinafter, implementation of this disclosure will be described in detail with reference to FIGS. 6 to 15B.

Referring to FIGS. 6 to 9, a liquid crystal display device according to an exemplary embodiment comprises a liquid crystal display panel, a timing controller 61, a data driving circuit 62, and a gate driving circuit 63. The data driving circuit 62 comprises a plurality of data drive ICs. The gate driving circuit 63 comprises a plurality of gate drive ICs 631 to 633.

The liquid crystal display panel comprises a liquid crystal layer interposed between two glass substrates. The liquid crystal display panel comprises m×n liquid crystal cells Clc arranged in a matrix form defined by m data lines 64 and n gate lines 65 which cross each other (herein, m and n are positive integer, respectively).

Figure 12A:
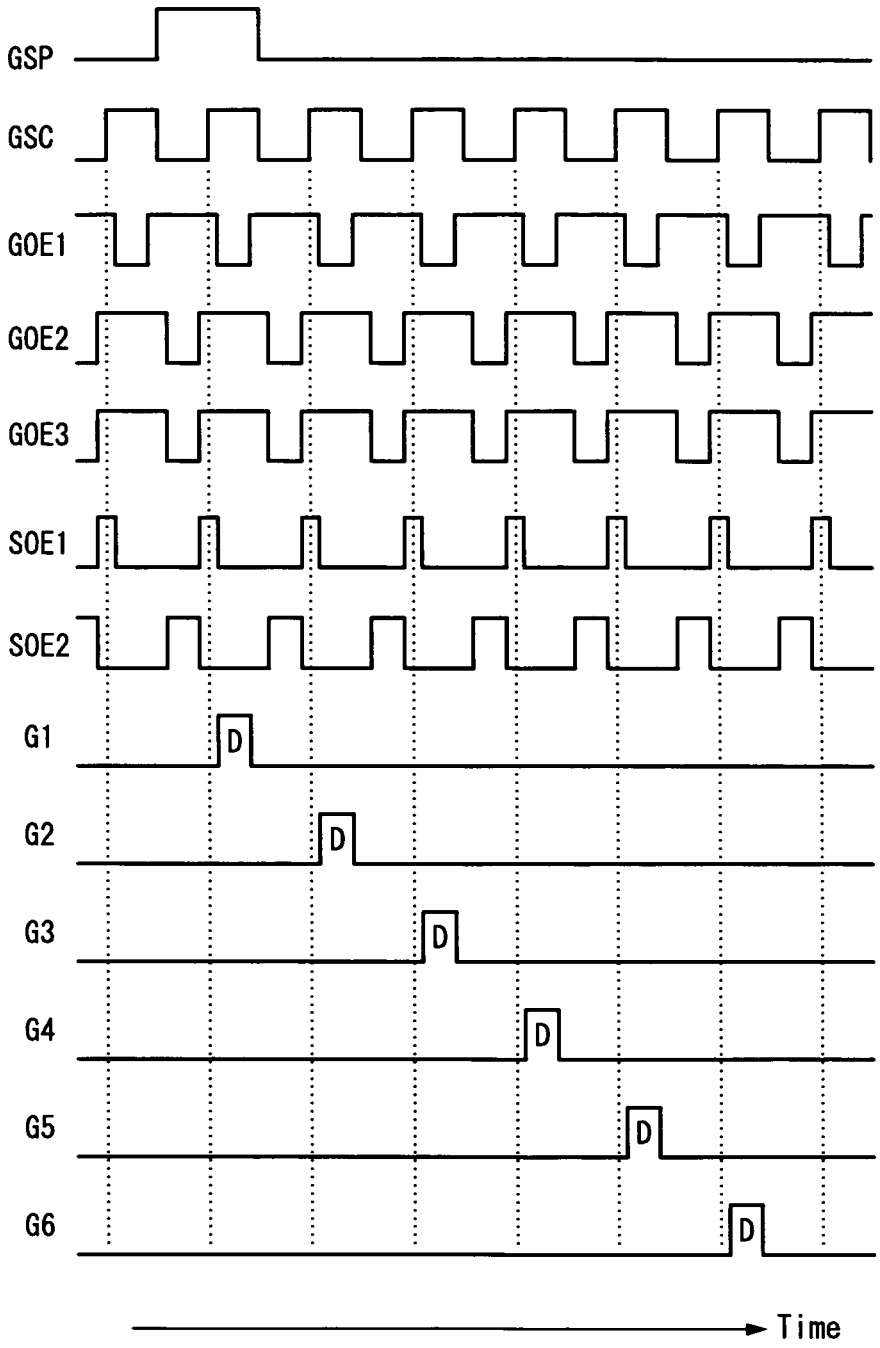
FIG. 12A is a timing diagram showing gate timing control signals, first and second source output enable signals, and gate pulses generated for period T1 of FIG. 10.
Figure 12B:
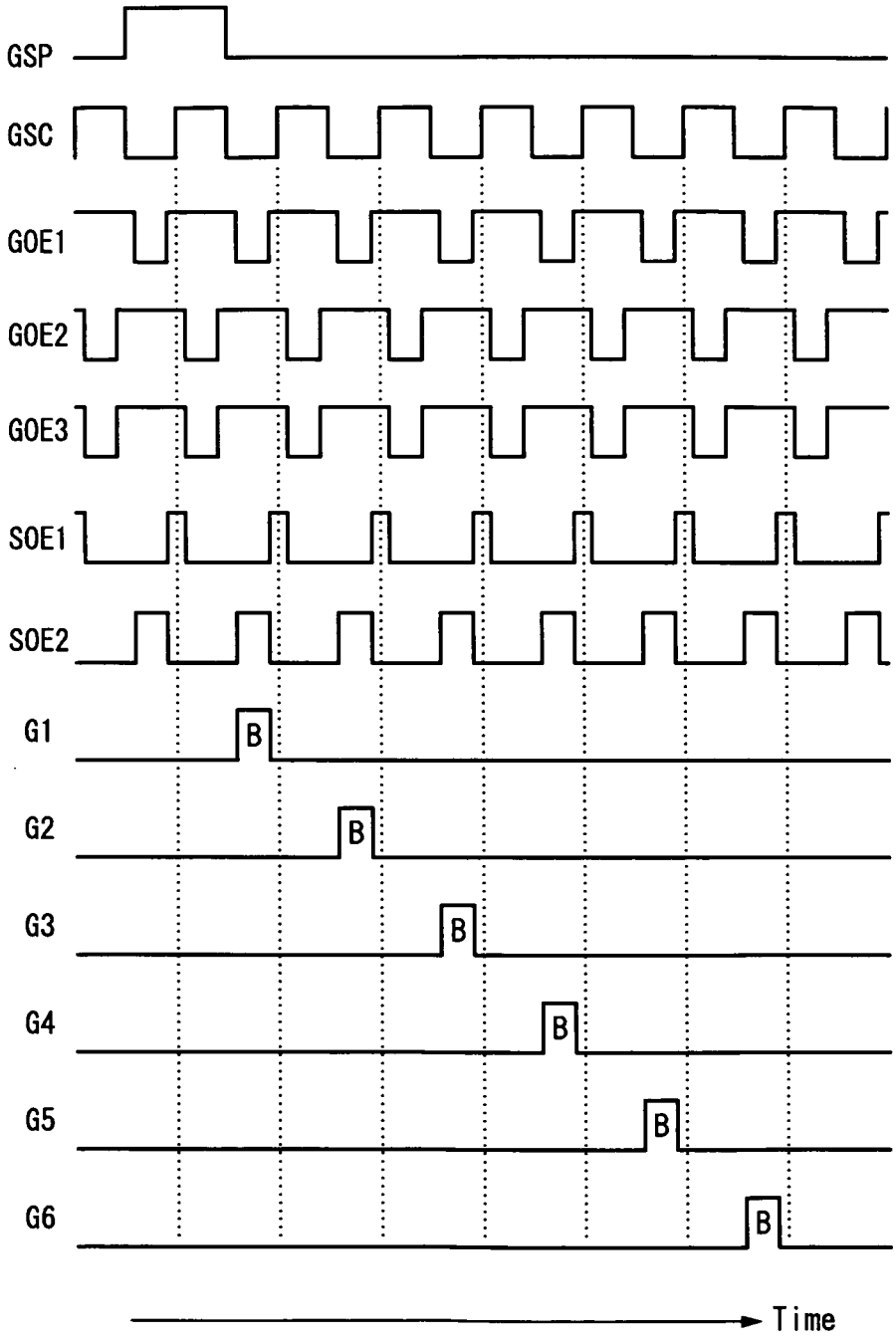
FIG. 12B is a timing diagram showing gate timing control signals, first and second source output enable signals, and gate pulses generated for period T3 of FIG. 10.

A pixel array including the data lines 64, the gate lines 65, thin film transistors (TFTs), and storage capacitors Cst are formed on a lower glass substrate of the liquid crystal display panel. Liquid crystal cells Clc are connected to the TFTs, resepectively. Each of the liquid crystal cell Clc is driven by an electric field between a pixel electrode 1 and a common electrode 2. Each of the TFTs includes a gate electrode connected to the gate line 64, a source electrode connected to the data line 64 and a drain electrode connected to a pixel electrode 1 of the liquid crystal cell Clc. The TFT is turned on in response to gate pulses G1 to G6 as shown in FIGS. 12A, 12B, 15B and 15B via the gate line 65 to supply positive/negative analog video data voltages and positive/negative black voltages from the data line 64 to the pixel electrode 1 of the liquid crystal cell.

A black matrix, a color filter, and the common electrode 2 are formed on an upper glass substrate of the liquid crystal display panel.

The common electrode 2 may be formed on the upper glass substrate in a vertical electric field type driving configuration such as a twisted nematic (TN) mode and a vertical alignment (VA) mode. Alternatively, the common electrode 2 may be formed on a lower glass substrate together with the pixel electrode 1 in a horizontal electric field type driving configuration such as an in-plane switching (IPS) mode and a fringe field switch (FFS) mode.

Polarizers are disposed on the respective upper and lower glass substrates of the liquid crystal display panel, respectively, and alignment films for setting a pre-tilt angle of the liquid crystals are provided. Spacers are disposed between the upper and lower glass substrates of the liquid crystal display panel for maintaining a cell gap therebetween.

Any other liquid crystal modes as well as TN mode, VA mode, IPS mode and FFS mode can be applied to the liquid crystal display panel of this invention. Also, the liquid crystal display device according to this invention can be implemented by any other type liquid crystal display device as well as a transmissive type liquid crystal display device, tranflective type liquid crystal display device, and a reflective type liquid crystal display device.

A display screen of the liquid crystal display panel is divided into a plurality of blocks BL1 to BL3 and is driven by gate timing control signals applied to the gate drive ICs 631 to 633. Each of the blocks BL1 to BL3 sequentially charges video data voltages one line by one line, and sequentially charges black voltages one line by one line. Herein, each of the lines includes liquid crystal cells arranged at the line. The liquid crystal cells arranged at a same line concurrently charge voltage from the data lines by TFTs which are connected to the same gate line and are concurrently turned on by the same gate pulse. The liquid crystal cells charge a data voltage and a black voltage when a first gate pulse synchronized with the data voltage and a second gate pulse synchronized with the black voltage are applied thereto. The total time charging the data voltage and the black voltage is larger than 0 and is one horizontal period or less. The liquid crystal cells charge the data voltage at first and then charge the black voltage later. Otherwise, the liquid crystal cells may charge the black voltage at first and then charge the data voltage later. Periods charging and retaining the data voltage and periods charging and retaining the black voltage are adjusted through a timing control by gate timing control signals, which will be described later. As thus, the periods charging the black voltage and the data voltage are adjusted by the timing control. The liquid crystal cells charge the black voltage within one horizontal period and retain the black voltage during a period having 25% to 75% of one frame period.

The timing controller 61 receives timing signals, such as vertical/horizontal synchronization signals Vsync and Hsync, an external data enable signal EDE, and a dot clock CLK, and generates control signals for controlling operation timings of the data driving circuit 62 and the gate driving circuit 63. The control signals comprise gate timing control signals and data timing control signals. Moreover, the timing controller 61 supplies digital video data RGB' to the data driving circuit 62.

The gate timing control signals comprise a gate start pulse GSP, a gate shift clock GSC, and gate output enable signals GOE1 to GOE3.

The gate start pulse GSP is applied to the first gate drive IC 631 and instructs a start time when a scan starts so that a first gate pulse is generated from the first gate drive IC 631. In the liquid crystal display device and the driving method thereof according to the exemplary embodiment, the gate start pulses GSP is generated two times within one frame period. That is, the gate start pulse GSP generated within one frame period includes a first gate pulse for charging the data voltage of the liquid crystal cells and a second gate pulse for charging the black voltage of the liquid crystal cells. A pulse width of each of the gate pulses is about one horizontal period.

The gate shift clock GSC is a clock signal for shifting the gate start pulse GSP. Shift registers of the gate drive ICs 631 to 633 shift the gate start pulse GSP at a rising edge of the gate shift clock GSC, respectively. Each of the second and third gate drive ICs 632 and 633 is operated when it receives a carry signal supplied from the gate drive IC at previous stage as a gate start pulse.

The gate output enable signals GOE1 to GOE 3 are respectively applied to the gate drive ICs 631 to 633. The gate drive ICs 631 to 633 output the gate pulses during a low logic period (at a low logic voltage) of the gate output enable signals GOE1 to GOE 3, i.e., for a period from directly after the falling edge of a previous pulse to just before the rising edge of a next pulse. One period of the gate output enable signals GOE 1 to GOE 3 is about one horizontal period, and a low logic retaining period within the one period is about one half horizontal period or less. Each of the gate drive ICs 631 to 633 generates gate pulses having a pulse which is about one half horizontal period or less in response to each of the low logic voltage of the gate output enable signals GOE1 to GOE 3

The data timing control signals comprise a source start pulse SSP, a source sampling clock SSC, a polarity control signal POL, a first source output enable signals SOE1 and a second source output enable signal SOE2.

The source start pulse SSP instructs a start pixel in a first horizontal line in which a video data is to be displayed. If a data transmission method between the timing controller 61 and the data driving circuit 62 is a mini low-voltage differential signaling (LVDS) method, a mini LVDS clock is transmitted to the data driving circuit 62 together with the digital video data RGB'. As such, in case that the video data is transmitted to the data driving circuit 62 by the mine LVDS method, the timing controller 61 does not generate an source start pulse SSP because a pulse following by a reset pulse of the mini LVDS clock serves as the source start pulse.

The source sampling clock SSC instructs sampling and latching operations of the data driving circuit 62 based on a rising or falling edge thereof.

The polarity control signal POL controls a polarity of an analog video data voltage output from the data driving circuit 62.

The first source output enable signal SOE1 controls a timing when a positive polarity/negative polarity analog video data voltage is output from the data driving circuit 62. Also, the first source output enable signal SOE1 controls a timing when a positive polarity/negative charge share voltage or a common voltage Vcom is output from the data driving circuit 62. The charge share voltage is generated when the data line to which the positive polarity voltage is supplied by the data driving circuit 62 is shorted with the data line to which the negative polarity voltage is supplied by the data driving circuit 62. The charge share voltage has an average voltage level between the positive polarity voltage and the negative polarity voltage.

The second source output enable signal SOE2 controls a timing when a positive polarity/negative polarity analog video data voltage is output from the data driving circuit 62. Pulse widths of the first and second source output enable signals SOE 1 and SOE2 are different from each other so that the black voltage and the data voltage are charged in the liquid crystal cells in a time-division. The data driving circuit 62 outputs the charge share voltage or the common voltage Vcom to the data lines 64 in synchronized with the pulse of the first source output enable signal SOE1. The data driving circuit 62 outputs the positive polarity/negative polarity analog video data voltage to the data lines 64 while the first and the second source output enable signals SOE1 and SOE2 are retained at the low logic voltage. Also, the data driving circuit 62 outputs the positive polarity/negative black voltage to the data lines 64 in synchronized with the pulse of the second source output enable signal SOE2.

Each of the gate drive ICs 631 to 633 sequentially supplies the gate pulses to the gate lines 65 in response to the gate timing control signals. The gate drive ICs 631 to 633 sequentially supply gate pulses to the gate lines when the first gate start pulse GSP is generated within one frame period, and then sequentially supply gate pulses to the gate lines when the second gate start pulse GSP is generated. Herein, each of the gate pulses has a pulse width which is about one half horizontal period or less.

The first gate drive IC 631 sequentially supply the gate pulses to the gate lines included in the first block BL1 in response to the gate start pulse GSP, the gate shift clock GSC and the first gate output enable signal GOE1 so that the gate pulses are synchronized with the positive polarity/negative polarity analog video data voltage and the positive polarity/negative polarity black voltage supplied to the liquid crystal cells of the first block BL1. Herein, each of the gate pulses has a pulse width which is about one half horizontal period or less.

The second gate drive IC 632 sequentially supply the gate pulses to the gate lines included in the second block BL2 in response to a carry signal as the gate start pulse from the first gate driver IC 631, the gate shift clock GSC and the second gate output enable signal GOE2 from the timing controller 61 so that the gate pulses are synchronized with the positive polarity/negative polarity analog video data voltage and the positive polarity/negative polarity black voltage supplied to the liquid crystal cells of the second block BL2. Herein, each of the gate pulses has a pulse width which is about one half horizontal period or less.

The third gate drive IC 633 sequentially supply the gate pulses to the gate lines included in the third block BL3 in response to a carry signal as the gate start pulse from the second gate drive IC 632, the gate shift clock GSC and the third gate output enable signal GOE3 from the timing controller 61 so that the gate pulses are synchronized with the positive polarity/negative polarity analog video data voltage and the positive polarity/negative polarity black voltage supplied to the liquid crystal cells of the third block BL3. Herein, each of the gate pulses has a pulse width which is about one half horizontal period or less.

Figure 7:
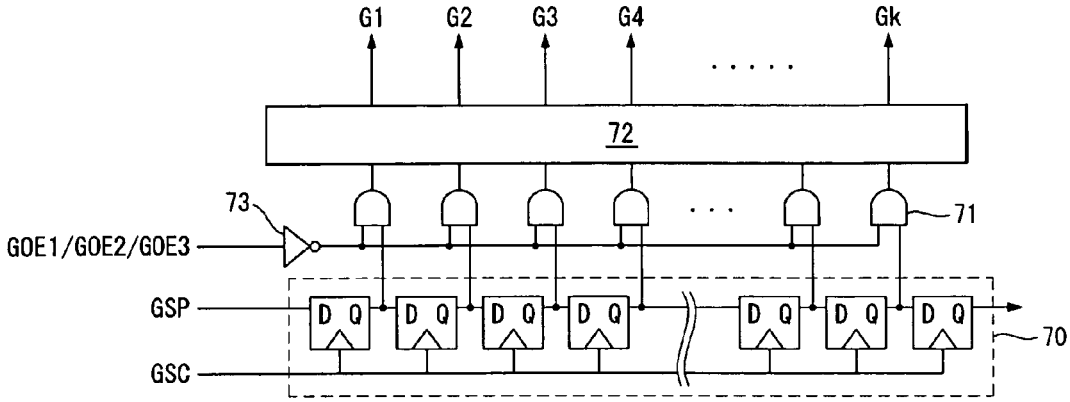
FIG. 7 is a circuit diagram showing a gate drive IC of FIG. 6.

Each of the gate drive ICs 631 to 633 comprises a shift register 70, a level shifter 72, a plurality of AND gates 71 connected between the shift register 70 and the level shifter 72, and an inverter 73 for inverting the gate output enable signals GOE1 to GOE3 as shown in FIG.7.

The shift resistor 70 sequentially shifts the gate start pulse GSP in accordance with the gate shift clock GSC using a plurality of serially connected D flip-flops. Each of the AND gates 71 generates an output by AND logic operating an output signal of the shift register 70 with an inverted signal of the gate output enable signals GOE1 to GOE3. The inverter 73 inverts the gate output enable signals GOE1 to GOE3 and supplies the inverted signals to the AND gates 71. As a result, the gate drive ICs 631 to 633 generate an output only when the gate output enable signals GOE1 to GOE3 are at a low logic level.

The level shifter 72 shifts a swing width of an output voltage from each AND gate 71 to a range suitable for driving the TFTs of the liquid crystal display panel. Output signals G1 to Gk of the level shifter 72 are sequentially supplied to k gate lines (wherein k is a positive integer).

The shift register 70 may be directly formed on the glass substrate of the liquid crystal panel together with the TFTs of the pixel array. In this case, the level shifter 72 may be not disposed on the glass substrate, but may be disposed on a control board or a source printed circuit board together with the timing controller 61 and a gamma voltage generating circuit.

Figure 8:
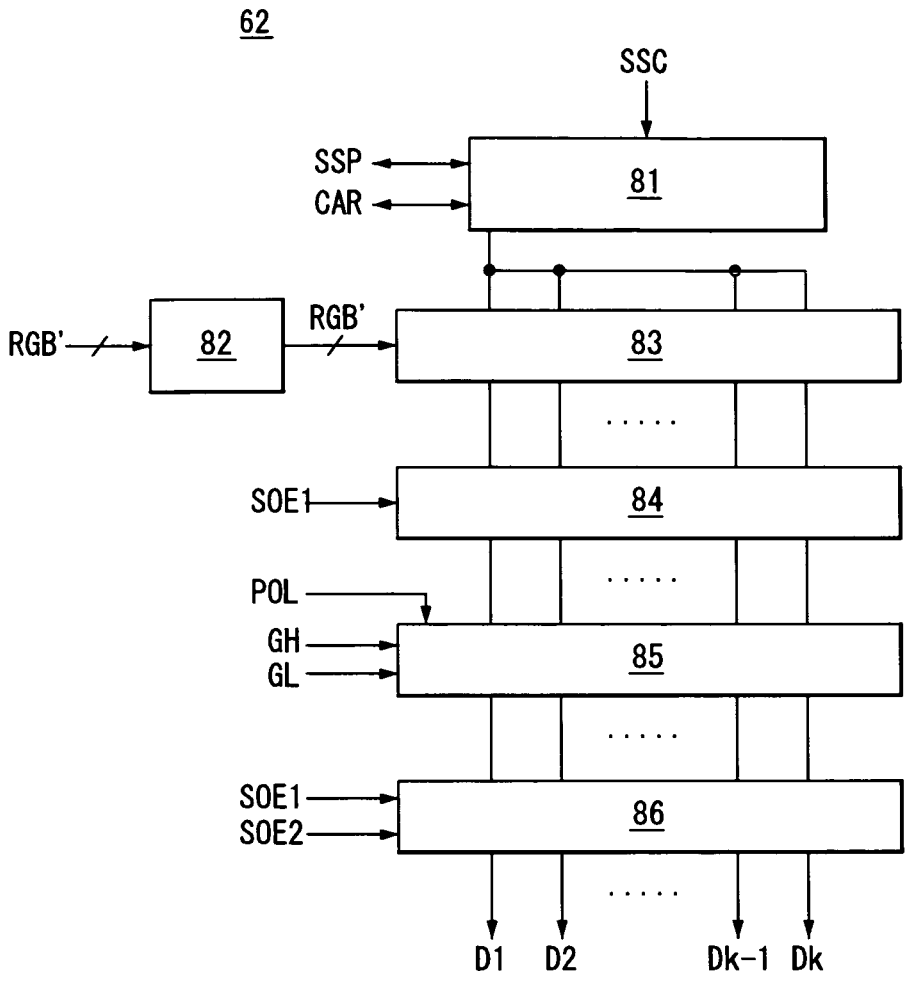
FIG. 8 is a block diagram showing a data drive IC of FIG. 6.
Figure 9:
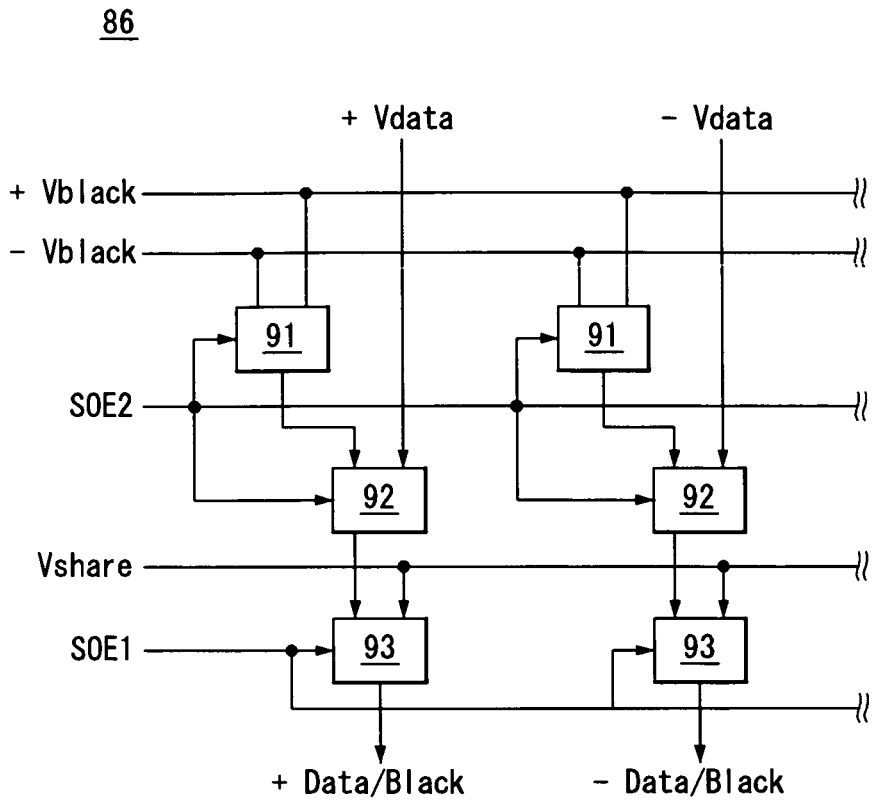
FIG. 9 is a circuit diagram showing an output control circuit of FIG. 8.

The data driving circuit 62 latches the digital video data RGB' and the digital black data BLACK, and then converts the digital video data RGB' and the digital black data BLACK into the positive polarity/negative polarity analog voltage in accordance with the control of the timing controller 61. Each of the data drive ICs in the data driving circuit 62 drives k data lines as shown in FIG. 8 (wherein, k is a positive integer smaller than m). The date drive IC comprises a shift register 81, a data register 82, a first latch 83, a second latch 84, a digital/analog converter (DAC) 85 and an output control circuit 86.

The shift register 81 shifts the source start pulse SSP from the timing controller 61 in accordance to the source sampling clock SSC to generate a sampling signal. Also, the shift register 81 shifts the source start pulse SSP to supply a carry signal CAR to a shift register included in a neighboring data drive IC.

The data register 82 temporarily stores the digital video data RGB' from the timing controller 61, and supplies the stored digital video data RGB' to the first latch 83. The first latch 83 samples and latches the digital data RGB' from the data register 82 in response to the sampling signal sequentially input from the shift register 81, and concurrently outputs the data RGB'. The second latch 84 latches the digital data RGB' from the first latch 81, and then outputs the data RGB' together with second latches included in another data drive ICs during a low logic level of the first source output enable signal SOE1.

The DAC 85 converts the digital video data RGB' from the second latch 84 into a positive polarity gamma compensation voltage GH or a negative polarity gamma compensation voltage GL to obtain the positive polarity/negative polarity analog video data voltage.

The output control circuit 86 outputs the positive polarity/negative polarity analog video data voltage, the positive polarity/negative polarity black voltage and the charge share voltage (or common voltage) in response to the first and the second source output enable signal SOE1 and SOE2.

The output control circuit 86 comprises a first logic part 91, a second logic part 92 and a third logic part 93.

The first logic part 91 counts pulses of the second source output enable signal SOE2. During odd frame period, the first logic part 91 supplies the positive polarity black voltage +Vblack to the second logic part 92 in response to odd pulses of the second source output enable signal SOE2 and supplies the negative polarity black voltage −Vblack to the second logic part 92 in response to even pulses of the second source output enable signal SOE2. During even frame period, the first logic part 91 supplies the negative polarity black voltage −Vblack to the second logic part 92 in response to odd pulses of the second source output enable signal SOE2 and supplies the positive polarity black voltage +Vblack to the second logic part 92 in response to even pulses of the second source output enable signal SOE2. As thus, the first logic part 91 outputs the positive polarity/negative polarity black voltage +Vblack in response to the pulse of the second source output enable signal SOE2, and inverts the polarity of the black voltage supplied to the second logic part 92 in one horizontal period unit and one frame period unit. The more voltage charged in the liquid crystal cells of the liquid crystal display panel is high, the positive polarity black voltage +Vblack may be generated at the same potential as a gate high voltage Vgh which is the high logic level of the gate pulse of the positive polarity black voltage +Vblack, and the negative polarity black voltage −Vblack may be generated at the same potential as a gate low voltage Vgl which is the low logic level of the gate pulse of the negative polarity black voltage −Vblack when the liquid crystal display device is driven in normally white mode in which transmissivity of the liquid crystal cells is lower.

The second logic part 92 supplies the black voltage +Vblack and −Vblack from the first logic part 91 to the third logic part 93, and supplies the positive polarity/negative polarity analog video data +Vdata and −Vdata from the DAC 85 to the third logic part 93 during the low logic period of the second source output enable signal SOE2. Accordingly, the second logic part 92 continuously supplies the positive polarity/negative polarity analog video data +Vdata and −Vdata and the positive polarity/negative polarity black voltage +Vblack and −Vblack during one period of the second source output enable signal SOE2, i.e. one horizontal period.

The third logic part 93 supplies the charge share voltage Vshare or the common voltage Vcom to the data lines 64 via an output buffer of the output control circuit 86 in synchronized with the first source output enable signal SOE1, and supplies the positive polarity/negative polarity analog video data +Vdata and −Vdata and the positive polarity/negative polarity black voltage +Vblack and −Vblack from the second logic part 92 during the low logic period of the first source output enable signal SOE 1. Accordingly, the third logic part 93 sequentially supplies the charge share voltage Vshare or the common voltage Vcom, the positive polarity/negative polarity analog video data voltage +Vdata and −Vdata and the positive polarity/negative polarity black voltage +Vblack and −Vblack to the data lines 64 in response to the first source output enable signal SOE1 within one horizontal period as a first exemplary embodiment of this invention which will be described later. Also, the third logic part 93 sequentially supplies the charge share voltage −Vshare or the common voltage Vcom, the positive polarity/negative polarity black voltage +Vblack and −Vblack and the positive polarity/negative polarity analog video data voltage +Vdata and −Vdata to the data lines 64 in response to the first source output enable signal SOE1 within one horizontal period as a second exemplary embodiment of this invention which will be described later.

First Exemplary Embodiment

Figure 10:
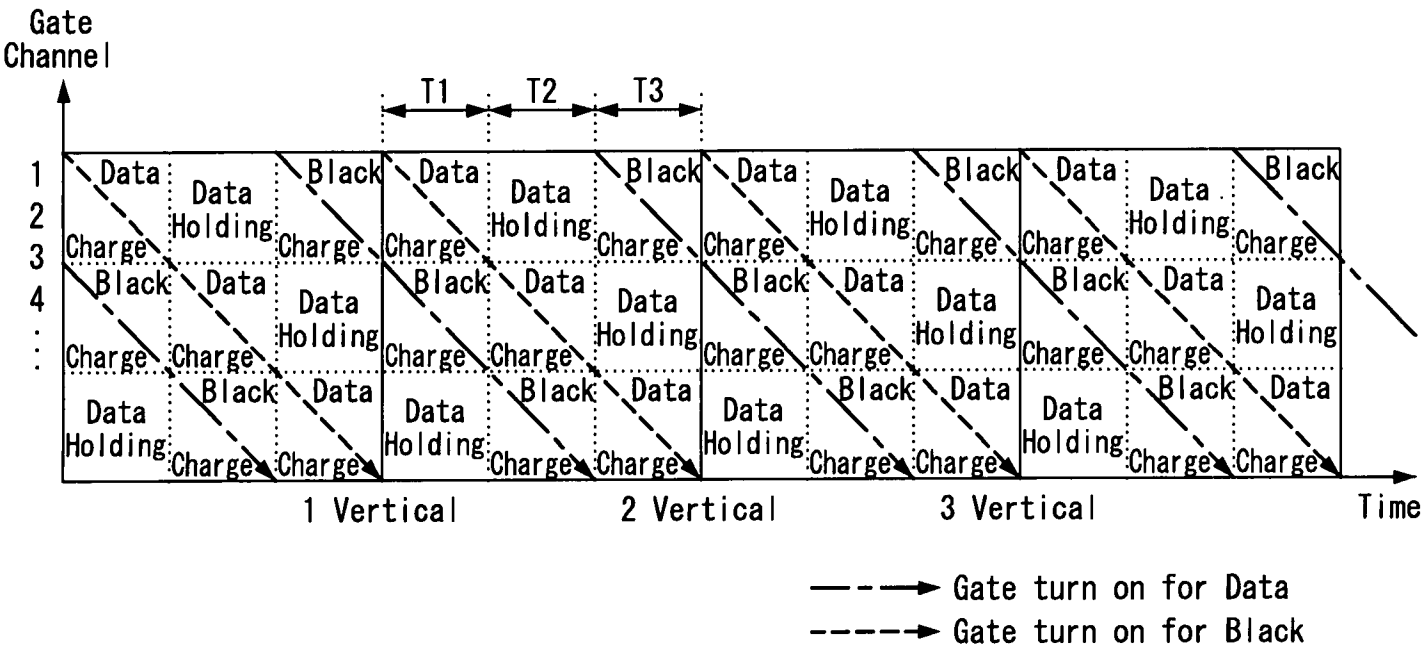
FIG. 10 is a diagram showing scanning operations of video data voltages and black voltages according to a first exemplary embodiment of this invention.
Figure 11:
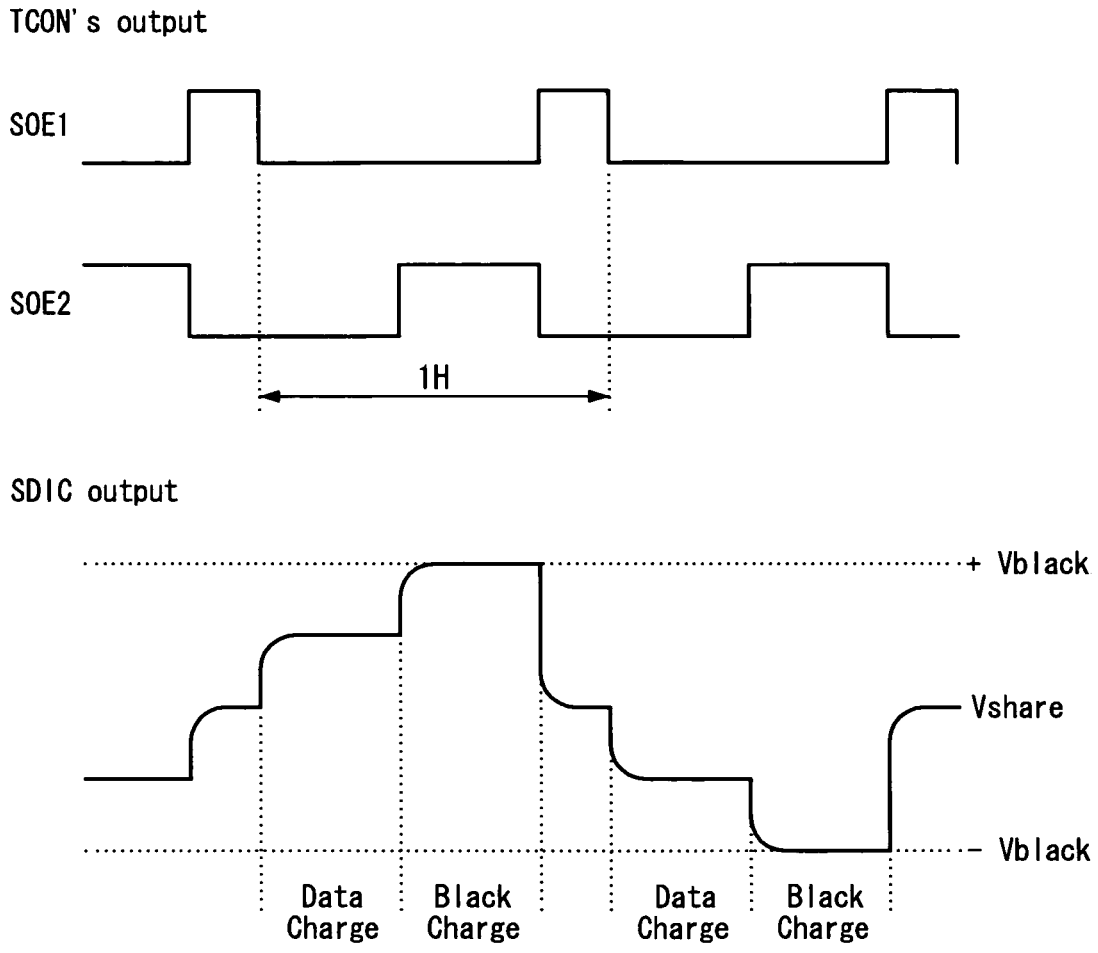
FIG. 11 is a waveform diagram showing the video data and black voltages charged in a liquid crystal cell by the scanning operations of FIG. 10.

FIG. 10 is a diagram showing scanning operations of the video data voltages and black voltages according to a first exemplary embodiment, FIG. 11 is a waveform diagram showing the video data and black voltages charged in the liquid crystal cell by the scanning operation as shown in FIG. 10, and FIG. 12A is a timing diagram showing the gate timing control signals GSP1, GSC and GOE1 to GOE3, the first and the second source output enable signals SOE1 and SOE2, and the gate pulses G1 to G6 generated for period T1 of FIG. 10. In FIG. 12A, a letter 'D' indicated in the gate pulses G1 to G6 means the data voltages charged in the liquid crystal cells. FIG. 12B is a timing diagram showing the gate timing control signal GSP2, a first and a second source output enable signals SOE1 and SOE2, and the gate pulses G1 to G6 generated for period T3 of FIG. 10. In FIG. 12B, a letter 'B' indicated in the gate pulses G1 to G6 means the black voltage charged in the liquid crystal cells.

Referring to FIGS. 10 to 12B, each of the blocks BL1 to BL3 of the liquid crystal display panel is time-divided into a positive polarity/negative polarity analog video data voltage charge period, a data retention period, a black voltage charge period and a black voltage retention period during one frame period (or one vertical period). The black voltage charge and retention periods may be approximately set to a period of 30% to 70% to one frame period by adjusting a delay time between the first and the second gate start pulses GSP1 and GSP2.

Each of the liquid crystal cells charges the charge share voltage Vshare or the common voltage Vcom while the pulse of the first source output enable signal SOE1 is generated by the output control circuit 86 of the data driving circuit 62 as shown in FIG. 11, and charges the positive polarity/negative polarity analog video data voltage when the first and the second source output enable signals SOE1 and SOE2 are retained at the low logic level. Each of the liquid crystal cells charges the charge the positive polarity/negative polarity black voltage while the pulse of the second source output enable signal SOE2 is generated by the output control circuit 86 of the data driving circuit 62. The black voltage charge period of the liquid crystal cells may be adjusted by the pulse width of the second source output enable signal SOE2.

During period T1, the first gate drive IC 631 is operated in response to the first gate start pulse GSP1 as shown in FIG. 12A. The first gate drive IC 631 outputs the gate pulses having a pulse width which is about one half horizontal period or less during the low logic level period of the first gate output enable signal GOE1, and shifts the gate pulses in accordance with the gate shift clock GSC. The gate pulses G1 to G6 which are about one half horizontal period or less are sequentially supplied to the gate lines included in the first block BL1. During period T1, the gate pulses G1 to G6 which are supplied to the gate lines of the first block BL1 are synchronized with the positive polarity/negative polarity analog video data voltage +Vdata and Vdata by the timing of the first gate output enable signal GOE1 and the source enable signals SOE1 and SOE2. Accordingly, the liquid crystal cells of the first block BL1 charge the positive polarity/negative polarity analog video data voltage +Vdata and −Vdata during the period T1.

During period T1, the second gate drive IC 632 is operated in response to the carry signal supplied from the first gate drive IC 632. The second gate drive IC 632 outputs the gate pulses having the pulse width which is about one half horizontal period or less during the low logic level period of the second gate output enable signal GOE2, and shifts the gate pulses in accordance with the gate shift clock GSC. The gate pulses G1 to G6 which are about one half horizontal period or less are sequentially supplied to the gate lines included in the second block BL2. During period T1, the gate pulses G1 to G6 which are supplied to the gate lines of the second block BL2 are synchronized with the positive polarity/negative polarity black voltage +Vblack and −Vblack by the timing of the second gate output enable signal GOE2 and the source enable signals SOE1 and SOE2. Accordingly, the liquid crystal cells of the second block BL2 charge the positive polarity/negative polarity black voltage +Vblack and −Vblack during the period T1.

During period T1, the carry signal supplied from the second gate drive IC 632 does not be supplied to the third gate drive IC 633. Accordingly, the third gate drive IC 633 does not generate the gate pulses during the period T1. As a result, the liquid crystal cells of the third block BL3 retains the positive polarity/negative polarity analog video data voltage +Vdata and −Vdata which were previously charged.

During period T2, the gate start pulse does not be supplied to the first gate drive IC 631. Accordingly, the first gate drive IC 631 does not generate the gate pulses during the period T2. As a result, the liquid crystal cells of the first block BL1 retain the positive polarity/negative polarity analog video data voltage +Vdata and −Vdata which were charged during the period T1.

As above-mentioned, during the period T1, the first gate drive IC 631 supplies the carry signal to the gate start pulse input terminal of the second gate drive IC 632 simultaneous with the start of the period T2 after the first gate drive IC 631 outputs the last gate pulse. During the period T2, the second drive IC 632 is operated in accordance with the carry signal supplied from the first gate drive IC 631 to output the gate pulses having the pulse width which is about one half horizontal period or less during the low logic period of the second gate output enable signal GOE2, and shift the gate pulses in accordance with the gate shift clock GSC. During the period T2, the gate pulses are sequentially supplied to the gate lines included in the second block BL2. Herein, the gate pulses are synchronized with the positive polarity/negative polarity analog video data voltages. +Vdata and −Vdata, and have the pulse width which is equal to or smaller than one half horizontal period. Accordingly, the liquid crystal cells of the second block BL2 charge the positive polarity/negative polarity analog video data voltages +Vdata and −Vdata during the period T2.

As above-mentioned, during the period T1, the second gate drive IC 632 supplies a carry signal to the gate start pulse input terminal of the third gate drive IC 633 simultaneous with the start of the period T2 after the second gate drive IC 632 outputs the last gate pulse. During the period T2, the third drive IC 633 is operated in accordance with the carry signal supplied from the second gate drive IC 632 to output the gate pulses having the pulse width which is equal to or smaller than about one half horizontal period during the low logic period of the third gate output enable signal GOE3, and shifts the gate pulses in accordance with the gate shift clock GSC. During the period T2, the gate pulses are sequentially supplied to the gate lines included in the third block BL3. Herein, the gate pulses are synchronized with the positive polarity/negative polarity black voltages +Vblack and −Vblack, and have the pulse width which is equal to or smaller than one half horizontal period. Accordingly, the liquid crystal cells of the third block BL3 charge the positive polarity/negative polarity black voltages +Vblack and −Vblack during the period T2.

During period T3, the first gate drive IC 631 is operated in response to the second gate start pulse GSP2 as shown in FIG. 12B. The first gate drive IC 631 outputs the gate pulses having the pulse width which is about one half horizontal period or less during the low logic level period of the first gate output enable signal GOE1, and shifts the gate pulses in accordance with the gate shift clock GSC. The gate pulses G1 to G6 which are about one half horizontal period or less are sequentially supplied to the gate lines included in the first block BL1. During period T3, the gate pulses G1 to G6 which are supplied to the gate lines of the first block BL1 are synchronized with the positive polarity/negative polarity black voltages +Vblack and −Vblack by the timing of the first gate output enable signal GOE1 and the source enable signals SOE1 and SOE2 as shown in FIG. 12B. Accordingly, the liquid crystal cells of the first block BL1 charge the positive polarity/negative polarity black voltages +Vblack and −Vblack during the period T3.

During period T3, the carry signal supplied from the first gate drive IC 631 does not be supplied to the second gate drive IC 632. Accordingly, the second gate drive IC 632 does not generate the gate pulses during the period T3. As a result, the liquid crystal cells of the second block BL2 retain the positive polarity/negative polarity analog video data voltage +Vdata and −Vdata which were charged during the period T2.

As above-mentioned, during the period T2, the second gate drive IC 632 supplies a carry signal to the gate start pulse input terminal of the third gate drive IC 633 simultaneous with the start of the period T2 after the second gate drive IC 632 outputs the last gate pulse. During the period T3, the third drive IC 633 is operated in accordance with the carry signal supplied from the second gate drive IC 632 to output the gate pulses having the pulse width which is about one half horizontal period or less during the low logic period of the third gate output enable signal GOE3, and shifts the gate pulses in accordance with the gate shift clock GSC. During the period T3, the gate pulses are sequentially supplied to the gate lines included in the third block BL3. Herein, the gate pulses are synchronized with the positive polarity/negative polarity analog video data voltages +Vdata and −Vdata, and have the pulse width which is about one half horizontal period or less. Accordingly, the liquid crystal cells of the third block BL3 charge the positive polarity/negative polarity analog video data voltages +Vdata and −Vdata during the period T3.

As shown in FIGS. 10, 12A and 12B, the time difference between the first gate start pulse GSP1 and the second gate start pulse GSP2 determines the time difference between the data voltage charge period and the black voltage charge period of the liquid crystal cells. The time difference is set to a range from one quarters frame period to three quarters frame period. Accordingly, it is possible to adjust the time difference between the first gate start pulse GSP1 and the second gate start pulse GSP2 in accordance with the charge and retention periods of the data voltages or the black voltages charged in the liquid crystal cells.

Second Exemplary Embodiment

Figure 13:
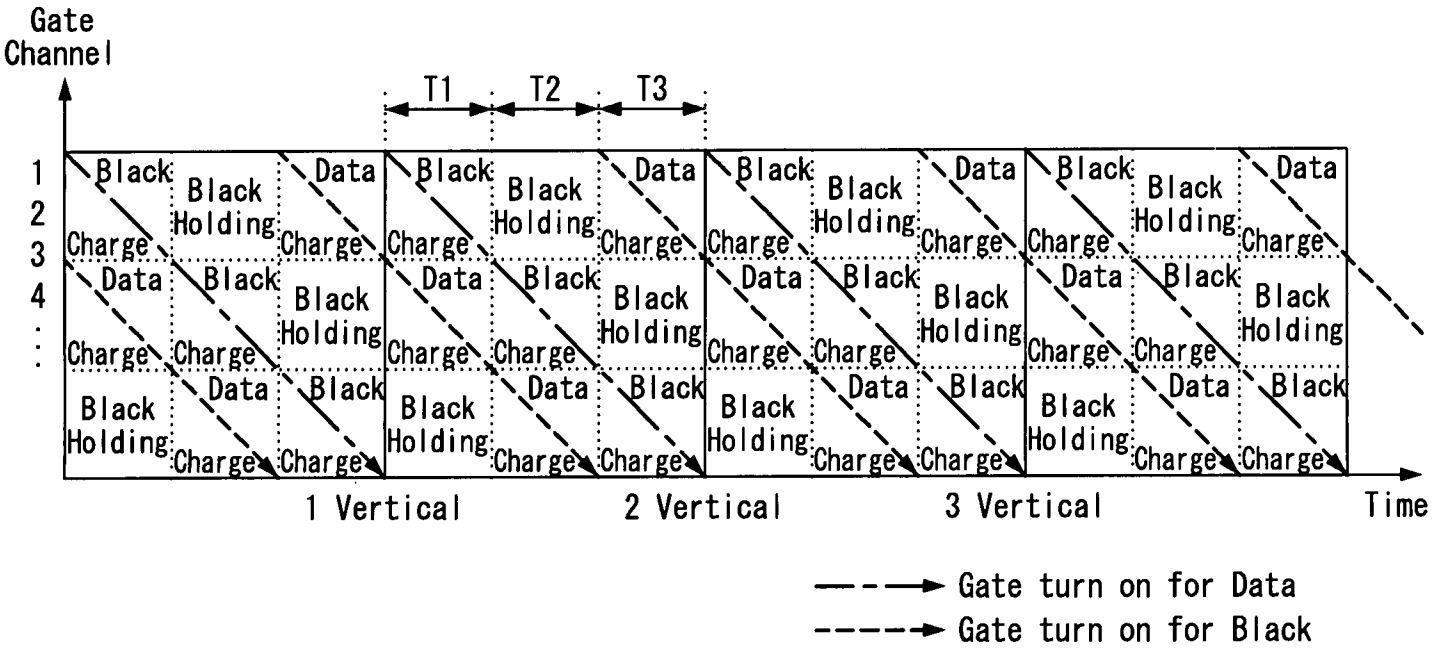
FIG. 13 is a diagram showing scanning operations of video data voltages and black voltages according to a second exemplary embodiment of this invention.
Figure 14:
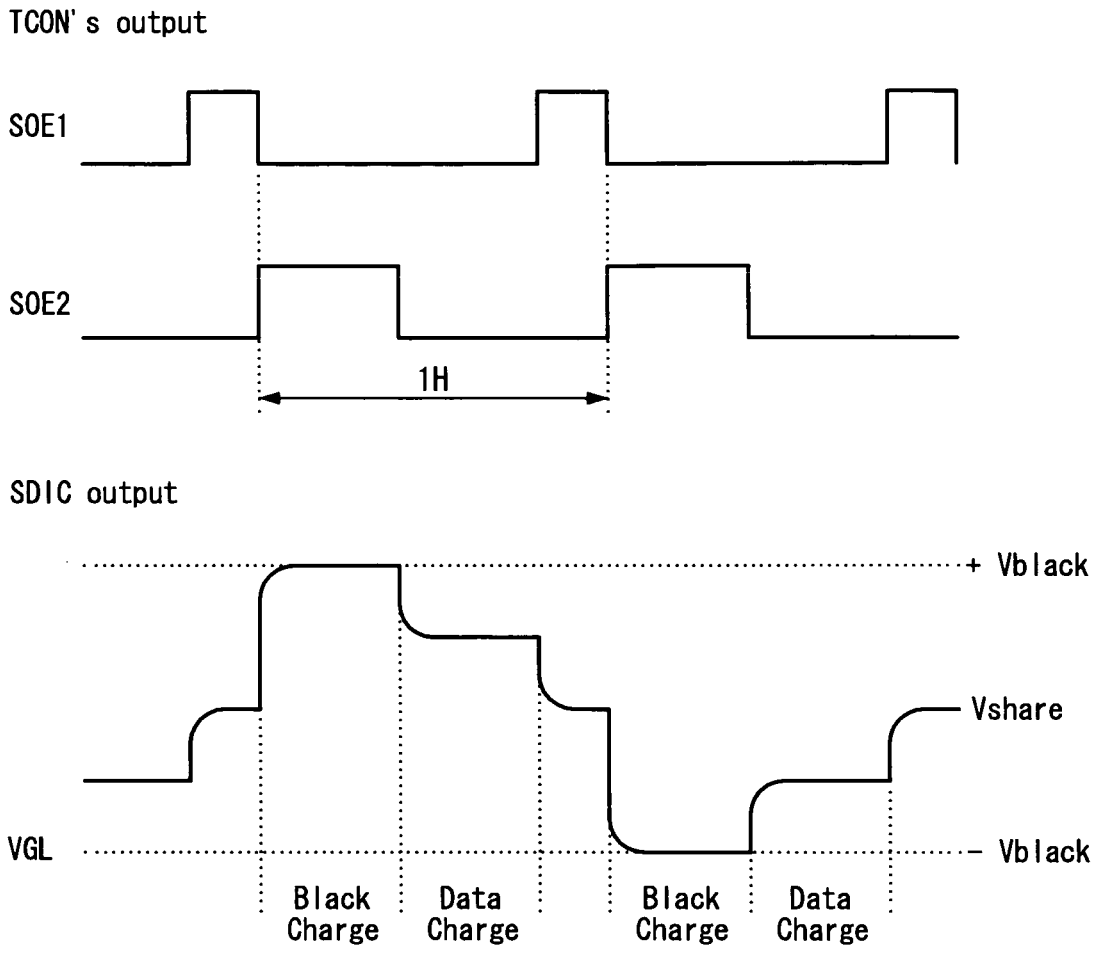
FIG. 14 is a waveform diagram showing the video data and black voltages charged in a liquid crystal cell by the scanning operations of FIG. 13.
Figure 15A:
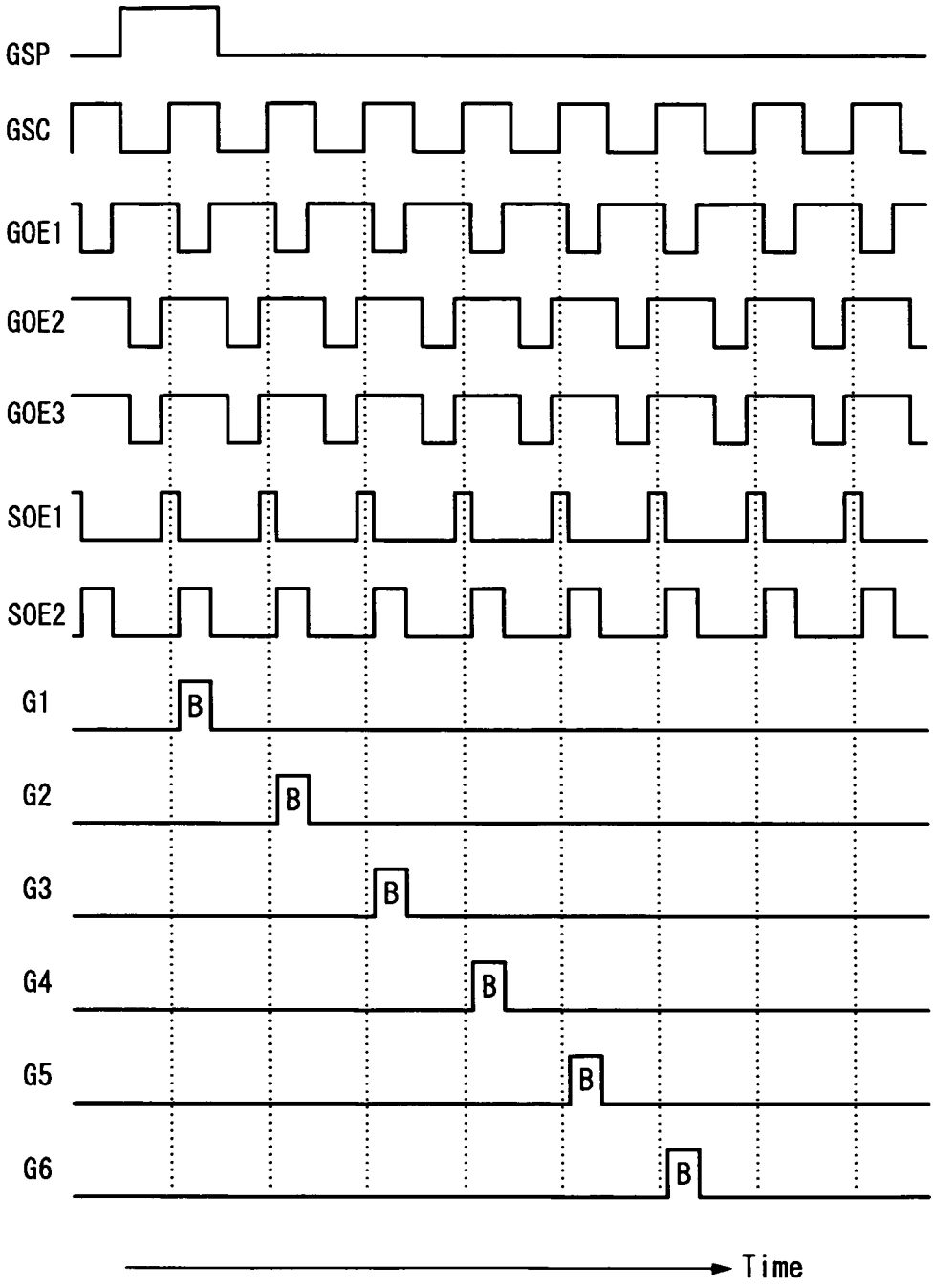
FIG. 15A is a timing diagram showing gate timing control signals, first and second source output enable signals, and gate pulses generated for Period T1 of FIG. 13.
Figure 15B:
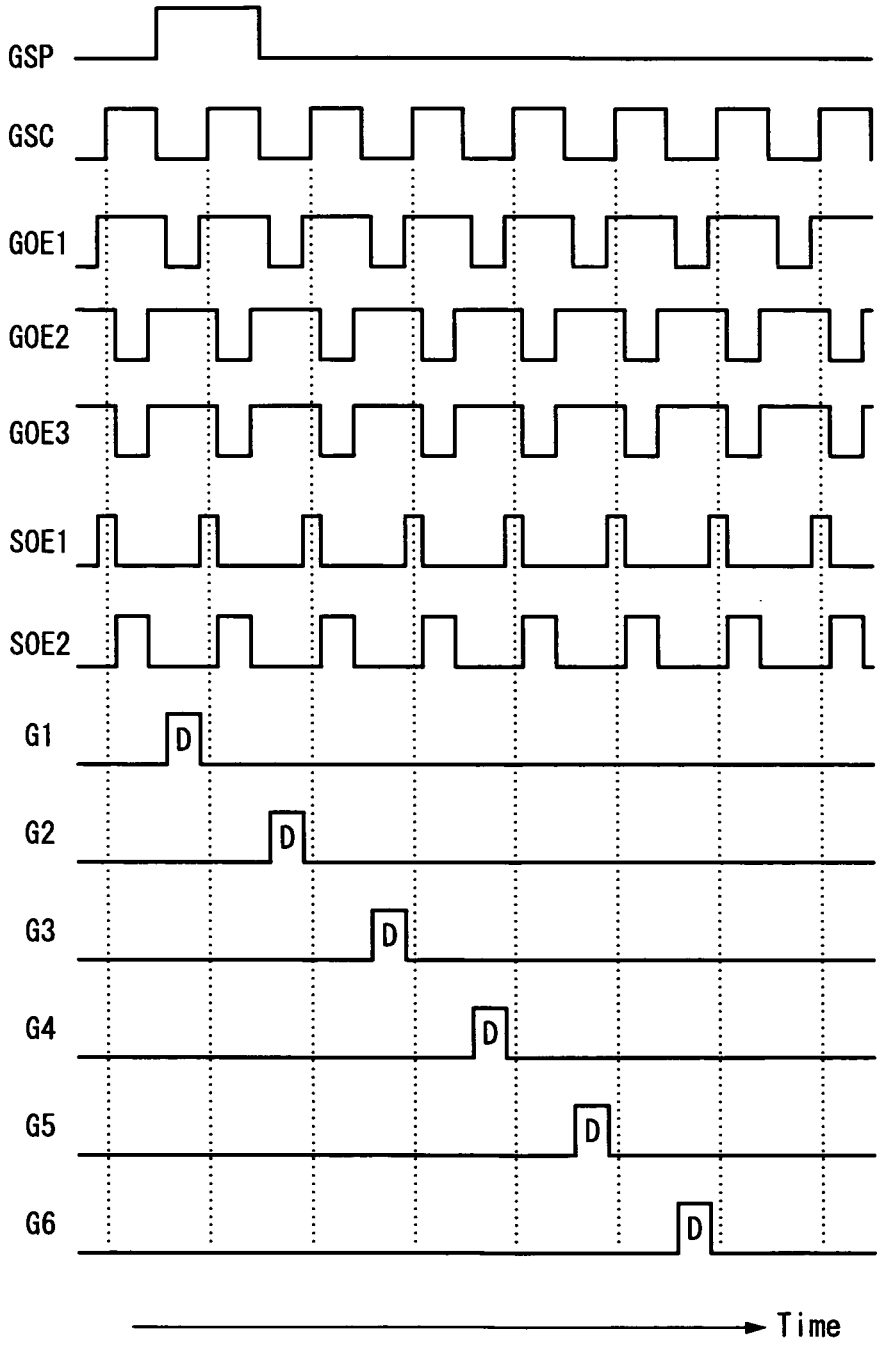
FIG. 15B is a timing diagram showing gate timing control signals, first and second source output enable signals, and gate pulses generated for period T3 of FIG. 13.

FIG. 13 is a diagram showing scanning operations of video data voltages and black voltages according to a second exemplary embodiment of this invention, FIG. 14 is a waveform diagram showing voltages charged in a liquid crystal cell by the scanning operations of FIG. 13, and FIG. 15A is a timing diagram showing the gate timing control signals GSP1, GSC, and GOE1 to GOE3, the first and second source output enable signals SOE1 and SOE2, and the gate pulses G1 o to G6 generated for period T1 of FIG. 13. In FIG. 15*a*, a letter indicated in the gate pulses G1 to G6 means the black voltage charged in the liquid crystal cells. FIG. 15B is a timing diagram showing the gate timing control signals GSP2, GSC and GOE1 to GOE3, the first and second source output enable signals SOE1 and SOE2, and the gate pulses generated for period T3 of FIG. 13. In FIG. 15*a*, a letter 'D' indicated in the gate pulses G1 to G6 means the black voltage charged in the liquid crystal cells.

Referring to FIGS. 13 to 15B, each of the blocks BL1 to BL3 of the liquid crystal display panel is time-divided into a positive polarity/negative polarity analog video data voltage charge period, a data retention period, a black voltage charge period and a black voltage retention period during one frame period (or one vertical period). The black voltage charge and retention periods may be approximately set to a period of 70% to one frame period, but it is not limited thereto. The black voltage charge and retention periods may be approximately set to a period of 30% to 70% one frame period by adjusting a delay time between the first and the second gate start pulses GSP1 and GSP2.

Each of the liquid crystal cells charges the charge share voltage Vshare or the common voltage Vcom while the pulse of the first source output enable signal SOE1 is generated by the output control circuit 86 of the data driving circuit 62 as shown in FIG. 14, and then charges the positive polarity/negative polarity black voltages while the second source output enable signal SOE2 are generated retained at the low logic level. Each of the liquid crystal cells charges the charge the positive polarity/negative polarity black voltages when the first and second source output enable signals SOE1 and SOE2 are retained at the low logic level by the output control circuit 86 of the data driving circuit 62.

During period T1, the first gate drive IC 631 is operated in response to the first gate start pulse GSP1 as shown in FIG. 15A. The first gate drive IC 631 outputs the gate pulses having a pulse width which is about one half horizontal period or less during the low logic level period of the first gate output enable signal GOE1, and shifts the gate pulses in accordance with the gate shift clock GSC. The gate pulses G1 to G6 which are about one half horizontal period or less are sequentially supplied to the gate lines included in the first block BL1. During period T1, the gate pulses G1 to G6 which are supplied to the gate lines of the first block BL1 are synchronized with the positive polarity/negative polarity black voltage +Vblack and −Vblack by the timing of the first gate output enable signal GOE1 and the source enable signals SOE1 and SOE2 as shown in FIG. 15A. Accordingly, the liquid crystal cells of the first block BL1 charge the positive polarity/negative polarity analog video data voltage +Vdata and −Vdata during the period T1.

During period T1, the second gate drive IC 632 is operated in response to the carry signal supplied from the first gate drive IC 632. The second gate drive IC 632 outputs the gate pulses having the pulse width which is about one half horizontal period or less during the low logic level period of the second gate output enable signal GOE2 and shifts the gate pulses in accordance with the gate shift clock GSC. The gate pulses G1 to G6 which are about one half horizontal period or less are sequentially supplied to the gate lines included in the second block BL2. During period T1, the gate pulses G1 to G6 which are supplied to the gate lines of the second block BL2 are synchronized with the positive polarity/negative polarity analog video data voltages +Vdata and −Vdata by the timing of the second gate output enable signal GOE2 and the source enable signals SOE1 and SOE2. Accordingly, the liquid crystal cells of the second block BL2 charge the positive polarity/negative polarity analog video data voltages +Vdata and −Vdata during the period T1.

During period T1, the carry signal supplied from the second gate drive IC 632 does not be supplied to the third gate drive IC 633. Accordingly, the third gate drive IC 633 does not generate the gate pulses during the period T1. As a result, the liquid crystal cells of the third block BL3 retain the positive polarity/negative polarity black voltages +Vblack and −Vblack which were previously charged.

During period T2, the gate start pulse does not be supplied to the first gate drive IC 631. Accordingly, the first gate drive IC 631 does not generate the gate pulses during the period T2. As a result, the liquid crystal cells of the first block BL1 retain the positive polarity/negative polarity black voltages +Vblack and −Vblack which were charged during the period T1.

As above-mentioned, during the period T1, the first gate drive IC 631 supplies the carry signal to the gate start pulse input terminal of the second gate drive IC 632 simultaneous with the start of the period T2 after the first gate drive IC 631 outputs the last gate pulse. During the period T2, the second drive IC 632 is operated in accordance with the carry signal supplied from the first gate drive IC 631 to output the gate pulses having the pulse width which is equal to or smaller than about one half horizontal period during the low logic period of the second gate output enable signal GOE2, and shift the gate pulses in accordance with the gate shift clock GSC. During the period T2, the gate pulses are sequentially supplied to the gate lines included in the second block BL2. Herein, the gate pulses are synchronized with the positive polarity/negative polarity black voltages +Vblack and −Vblack, and have the pulse width which is equal to or smaller than one half horizontal period. Accordingly, the liquid crystal cells of the second block BL2 charge the positive polarity/negative polarity black voltages +Vblack and −Vblack during the period T2.

As above-mentioned, during the period T1, the second gate drive IC 632 supplies a carry signal to the gate start pulse input terminal of the third gate drive IC 633 simultaneous with the start of the period T2 after the second gate drive IC 632 outputs the last gate pulse. During the period T2, the third drive IC 633 is operated in accordance with the carry signal supplied from the second gate drive IC 632 to output the gate pulses having the pulse width which is about one half horizontal period or less during the low logic period of the third gate output enable signal GOE3, and shifts the gate pulses in accordance with the gate shift clock GSC. During the period T2, the gate pulses are sequentially supplied to the gate lines included in the third block BL3. Herein, the gate pulses are synchronized with the positive polarity/negative polarity analog video data voltages +Vdata and −Vdata, and have the pulse width which is about one half horizontal period or less. Accordingly, the liquid crystal cells of the third block BL3 charge the positive polarity/negative polarity analog video data voltages +Vdata and −Vdata during the period T2.

During period T3, the first gate drive IC 631 is operated in response to the second gate start pulse GSP2 as shown in FIG. 15B. The first gate drive IC 631 outputs the gate pulses having the pulse width which is about one half horizontal period or less during the low logic level period of the first gate output enable signal GOE1, and shifts the gate pulses in accordance with the gate shift clock GSC. The gate pulses G1 to G6 which are about one half horizontal period or less are sequentially supplied to the gate lines included in the first block BL1. During period T3, the gate pulses G1 to G6 which are supplied to the gate lines of the first block BL1 are synchronized with the positive polarity/negative polarity analog video data voltages +Vdata and −Vdata by the timing of the first gate output enable signal GOE1 and the source enable signals SOE1 and SOE2 as shown in FIG. 15B. Accordingly, the liquid crystal cells of the first block BL1 charge the positive polarity/negative polarity analog video data voltages +Vdata and −Vdata during the period T3.

During period T3, the carry signal supplied from the first gate drive IC 631 does not be supplied to the second gate drive IC 632. Accordingly, the second gate drive IC 632 does not generate the gate pulses during the period T3. As a result, the liquid crystal cells of the second block BL2 retain the positive polarity/negative polarity black voltage +Vblack and −Vblack which were charged during the period T2.

As above-mentioned, during the period T2, the second gate drive IC 632 supplies a carry signal to the gate start pulse input terminal of the third gate drive IC 633 simultaneous with the start of the period T2 after the second gate drive IC 632 outputs the last gate pulse. During the period T3, the third drive IC 633 is operated in accordance with the carry signal supplied from the second gate drive IC 632 to output the gate pulses having the pulse width which is about one half horizontal period or less during the low logic period of the third gate output enable signal GOE3, and shifts the gate pulses in accordance with the gate shift clock GSC. During the period T3, the gate pulses are sequentially supplied to the gate lines included in the third block BL3. Herein, the gate pulses are synchronized with the positive polarity/negative polarity black voltages +Vblack and −Vblack, and have the pulse width which about one half horizontal period or less. Accordingly, the liquid crystal cells of the third block BL3 charge the positive polarity/negative polarity black voltages +Vblack and −Vblack during the period T3.

As shown in FIGS. 13, 15A and 15B, the time difference between the first gate start pulse GSP1 and the second gate start pulse GSP2 determines the time difference between the data voltage charge period and the black voltage charge period of the liquid crystal cells. The time difference is set to a range of one quarter frame period to three quarters frame period. Accordingly, it is possible to adjust the time difference between the first gate start pulse GSP1 and the second gate start pulse GSP in accordance with the charge and retention periods of the data voltages or the black voltages charged in the liquid crystal cells.

As above-mentioned, the liquid crystal display device according to the exemplary embodiments of this invention generates the gate pulses having a same pulse width within one frame period, applies individual gate output enable signals to the gate drive ICs, respectively, and controls the data voltages and the black voltages charged in the liquid crystal cells using two source output enable signals of which phases are different each other. As a result, it is possible to minimize capacitance of memory necessary for storing a large quantity of data because it does not have to store the large quantity of data. Also it is possible to implement an impulsive driving method by simplifying a logic circuit and control algorism of the timing controller.

On the other hand, the pulse width of the gate pulse does not limited to one half horizontal period. The pulse width may be adjusted at a range from above zero to one horizontal period and less. However, the sum of the pulse width of the gate pulses synchronized with the positive polarity/negative polarity analog video data voltages and the pulse width of the gate pulses synchronized with the positive polarity/negative black voltages is over zero to one horizontal period and less.

According to the liquid crystal display device and driving method thereof minimize capacitance of memory necessary for storing a large quantity of data because it does not have to store the large quantity of data. Also it is possible to implement an impulsive driving method by simplifying a logic circuit and control algorism of the timing controller.

It will be apparent to those skilled in the art that various modifications and variations can be made in the embodiments of the invention without departing from the spirit or scope of the invention. Thus, it is intended that exemplary embodiments of the invention cover the modifications and variations of this invention provided they come within the scope of the appended claims and their equivalents.

What is claimed is:

1. A liquid crystal display device comprising:

a liquid crystal display panel on which a plurality of data lines and a plurality of gate lines cross each other, and having a common electrode;

a timing controller that generates a gate timing control signal and a data timing control signal, wherein the gate timing control signal includes a first and second gate start pulses generated in one frame period, a gate shift clock, a first gate output enable signal and a second gate output enable signal, and wherein the data timing control signal includes a first source output enable signal and a second source output enable signal;

a data driving circuit that supplies positive polarity/negative polarity analog video data voltages to the data lines when the first and second source output enable signals are input thereto at a same logic level, and supplies positive polarity/negative polarity black voltages to the data lines in response to a pulse of the second source output enable signal;

a first gate drive IC that shifts the first and second gate start pulses in accordance with the gate shift clock, and sequentially supplies first gate pulses which are synchronized with the positive polarity/negative polarity analog video data voltages to the gate lines included in a first block of the liquid crystal display panel during a low logic period of the first gate output enable signal; and a second gate drive IC that shifts a first carry signal supplied from the first gate drive IC in accordance with the gate shift clock and sequentially shifts second gate pulses which are synchronized with the positive polarity/negative polarity black voltages to the gate lines included in a second block of the liquid crystal display panel during a low logic period of the second gate output enable signal, wherein a pulse width of the second source output enable signal is longer than that of the first source output enable signal, and a phase of the first source output enable signal is different from that of the second source output enable signal.

2. The liquid crystal display device of claim 1, wherein the data driving circuit is configured to supply any one of a common voltage supplied to the common electrode and a charge share voltage to the plurality of data lines in response to a pulse of the first source output enable signal, wherein the charge share voltage is set to an average voltage of neighboring data lines.

3. The liquid crystal display device of claim 1, wherein a sum of a pulse width of the gate pulse synchronized with the positive polarity/negative polarity analog video data voltage and a pulse width of the gate pulse synchronized with the positive polarity/negative polarity black voltage is over zero and one horizontal period and less.

4. The liquid crystal display device of claim 1, wherein a time difference between the first gate start pulse and the second gate start pulse is one quarter frame or more and is under three quarters frame period.

5. A method of driving a liquid crystal display device comprising a liquid crystal display panel on which a plurality of data lines and a plurality of gate lines cross each other and having a common electrode, the method comprising:

generating a gate timing control signal and a data timing control signal, wherein the gate timing control signal including a first and second gate start pulses generated in one frame period, a gate shift clock, a first gate output enable signal and a second gate output enable signal, and wherein the data timing control signal including a first source output enable signal and a second source output enable signal;

supplying positive polarity/negative polarity analog video data voltages to the data lines video data voltage to the data lines when the first and second source output enable signals are input at a same logic level, and supplying positive polarity/negative polarity black voltages to the data lines in response to a pulse of the second source output enable signal by using a data driving circuit;

shifting the first and second gate start pulses in accordance with the gate shift clock and sequentially supplying first gate pulses which are synchronized with the positive polarity/negative polarity analog video data voltages to the gate lines included in a first block of the liquid crystal display panel during a low logic period of the first gate output enable signal by using a first gate drive IC; and shifting a first carry signal supplied from the first gate drive IC in accordance with the gate shift clock, and sequentially supplying second gate pulses which are synchronized with the positive polarity/negative polarity black voltages to the gate lines included in a second block of the liquid crystal display panel during a low logic period of the second gate output enable signal by using a second gate drive IC, a pulse width of the second source output enable signal is longer than that of the first source output enable signal, and a phase of the first source output enable signal is different from that of the second source output enable signal.

6. The method of claim 5, further comprising, supplying any one of a common voltage supplied to the common electrode of the liquid crystal display panel and a charge share voltage to the plurality of data lines within the first output enable signal is generated, wherein the charge share voltage is set to an average voltage of neighboring data lines by using the data driving circuit.

7. The method of claim 5, wherein a sum of a pulse width of the gate pulse synchronized with the positive polarity/negative polarity analog video data voltage and a pulse width of the gate pulse synchronized with the positive polarity/negative polarity black voltage is over zero and one horizontal period and less.

8. The method of claim 5, wherein a time difference between the first gate start pulse and the second gate start pulse is one quarter frame or more and is under three quarters frame period.

* * * * *